US010300365B2

(12) United States Patent
Merlot

(10) Patent No.: US 10,300,365 B2
(45) Date of Patent: May 28, 2019

(54) SKATING TRACK OF THE SKATEBOARD RAMP TYPE COMPRISING A SELF-SUPPORTING CARRIER STRUCTURE MADE FROM RIGID FOAM AND A SKATING SURFACE

(71) Applicant: WOOD STRUCTURE, Richelieu (FR)

(72) Inventor: Frederic Merlot, Thilouze (FR)

(73) Assignee: WOOD STRUCTURE, Richelieu (FR)

( * ) Notice: Subject to any disclaimer, the term of this patent is extended or adjusted under 35 U.S.C. 154(b) by 0 days.

(21) Appl. No.: 15/773,795

(22) PCT Filed: Sep. 30, 2016

(86) PCT No.: PCT/FR2016/052505
§ 371 (c)(1),
(2) Date: May 4, 2018

(87) PCT Pub. No.: WO2017/077204
PCT Pub. Date: May 11, 2017

(65) Prior Publication Data

US 2018/0318701 A1 Nov. 8, 2018

(30) Foreign Application Priority Data

Nov. 7, 2015 (FR) ..... 15 60683

(51) Int. Cl.
*A63C 19/10* (2006.01)
*A63C 19/00* (2006.01)

(52) U.S. Cl.
CPC ..... *A63C 19/10* (2013.01); *A63C 2203/10* (2013.01)

(58) Field of Classification Search
CPC ..... A63C 19/00; A63C 19/10; A63H 33/00; A63H 33/04; A63H 33/08; A63H 33/084; A63H 33/086; A63H 33/105
(Continued)

(56) References Cited

U.S. PATENT DOCUMENTS 4,676,762 A * 6/1987 Ballard ..... A63H 33/105 446/104
6,623,367 B1 9/2003 Labelson et al.
(Continued)

FOREIGN PATENT DOCUMENTS

DE 9316454 U1 1/1994
WO 03039690 A1 5/2003
(Continued)

OTHER PUBLICATIONS

International Search Report dated Dec. 19, 2016 for corresponding International Application No. PCT/FR2016/052505, filed Sep. 30, 2016.
(Continued)

*Primary Examiner* — Kien T Nguyen
(74) *Attorney, Agent, or Firm* — David D. Brush; Westman, Champlin & Koehler, P.A.

(57) ABSTRACT

A skating track, in particular of the skateboard ramp type, includes: a self-supporting carrier structure of rigid foam, able to rest on the ground; and a skating surface attached to the carrier structure. The carrier structure has mortises and tenons embedded in the mortises. The skating surface is fixed to the tenons, the tenons and the mortises coupling the skating surface on the carrier structure and holding it in position.

12 Claims, 1 Drawing Sheet

(58) Field of Classification Search
USPC ..... 482/88–91; 446/120–121, 127; 472/88–91
See application file for complete search history.

(56) References Cited

U.S. PATENT DOCUMENTS

| | | | |
|---|---|---|---|
| 6,993,801 | B2 | 2/2006 | Marko et al. |
| 2005/0107170 | A1 | 5/2005 | Wang |
| 2006/0027794 | A1 | 2/2006 | Heinz |
| 2010/0050348 | A1 | 3/2010 | Mapp |
| 2012/0021844 | A1 | 1/2012 | Thompson |

FOREIGN PATENT DOCUMENTS

| | | | |
|---|---|---|---|
| WO | 2005009554 | A2 | 2/2005 |
| WO | 2009126869 | A2 | 10/2009 |

OTHER PUBLICATIONS

Written Opinion of the International Searching Authority dated Dec. 19, 2016 for corresponding International Application No. PCT/FR2016/052505, filed Sep. 30, 2016.
English translation of the Written Opinion of the International Searching Authority dated Dec. 19, 2016 for corresponding International Application No. PCT/FR2016/052505, filed Sep. 30, 2016.

* cited by examiner

SKATING TRACK OF THE SKATEBOARD RAMP TYPE COMPRISING A SELF-SUPPORTING CARRIER STRUCTURE MADE FROM RIGID FOAM AND A SKATING SURFACE

CROSS-REFERENCE TO RELATED APPLICATIONS

This Application is a Section 371 National Stage Application of International Application No. PCT/FR2016/052505, filed Sep. 30, 2016, the content of which is incorporated herein by reference in its entirety, and published as WO on, not in English.

FIELD OF THE DISCLOSURE

The field of the invention is that of the design and manufacture of sporting and recreational structures.

More precisely, the invention relates to a skating track of the skateboard ramp type that is simple and economical to produce and easy to transport and install and optionally to uninstall.

BACKGROUND OF THE DISCLOSURE

In the field of the invention, skateboard ramps are known that are integrated in a skateboard park produced from concrete.

Skateboard ramps are also known that can be installed and uninstalled at a suitable place. These ramps then have a skating surface supported by a carrier structure. This carrier structure can in particular consist of a framework of the wooden framework or even metal framework type.

This type of framework can be installed permanently or temporarily, for example during competitions. They may thus be dismantled after use in order to be transported more easily. It may be noted that this type of framework has drawbacks. This is because assembly and/or disassembly may not be easy and then be particularly time-consuming. Thus transporting the dismantled framework may be complex because of a multiplicity of components of the framework and/or the weight of these components.

Skateboard and/or fingerboard ramps are also known, such as those described in the patent document published under the number U.S. Pat. No. 6,623,367 B1. According to the technique described by this document, the ramps have a skating surface conventionally supported by a carrier structure. More precisely, the carrier structure comprises at least two lateral frames coupled together by means of rafters in order to hold the lateral frames in position. The skating surface is then coupled to the lateral frames, and the carrier structure, thus closed, can be filled with rigid foam or a ballast so as to stiffen the assembly.

These ramps do however have drawbacks. This is because, through their design, they may have a relatively high manufacturing cost because of the adjustments necessary to the couplings. Thus these ramps may not be easy to transport, install and dismantle.

The prior art also proposes adaptable skateboard ramps such as those described in the patent document published under the number WO 2005/009554 A2. The ramps described in this document comprise at least two types of module: a first type of module having an inclined skating surface, and a second type of module having a horizontal skating surface able to serve as a support for the first type of module, if the latter must be elevated. These modules all have the particularity of being able to be assembled with each other by means of a nestable connection. Thus these modules are hollow and designed to be moulded, for example with high-density polyethylene.

The modules described in this document thus make it possible to adapt the form of the skateboard ramp easily and quickly, as well as being easy to transport. This type of skateboard ramp does not nevertheless have the drawbacks of being relatively expensive and complex to produce.

SUMMARY

An exemplary embodiment of the invention relates to a skating track, in particular of the skateboard ramp type, comprising:

- a self-supporting carrier structure consisting of rigid foam, able to rest on the ground;
- a skating surface attached to the carrier structure, characterised in that the carrier structure has mortises, and in that it has tenons embedded in the mortises, the skating surface being fixed to the tenons, the tenons and the mortises forming means for coupling the skating surface on the carrier structure and holding it in position.

A skating track according to the invention is thus particularly simple and economical to produce. This is because it suffices to cut mortises in the carrier structure consisting of rigid foam for the latter to be ready. Next the tenons are sized and produced so as to be complementary to the mortises in which they are embedded. Finally, the skating surface is sized so that it can be simply pressed on the face of the carrier structure, which has tenons embedded in the mortises, and then coupled to these embedded tenons.

Thus the skating track according to the invention is easy to transport so as for example to be delivered to a customer. This is because the carrier structure consisting of rigid foam can be sent all alone so as not to burden a bulky package, and the skating surface and the tenons, which are heavier, can be the subject of a plurality of smaller packages.

Finally, the skating track according to the invention is easy to install. This is because the person carrying out the installation merely has to embed the tenons in the mortises and couple the skating surface to the embedded tenons.

According to another advantage of a skating track according to the invention, the skating surface can be adapted according to the requirements of its users. This is because this skating surface may be provided with particular properties (hardness, adhesion, etc.).

According to an advantageous feature the tenons and mortises form a mechanical connection of the dovetail type.

This mechanical connection makes it possible to optimise the holding of the skating surface in position in the carrier structure.

According to a preferential embodiment, the skating surface is coupled to the tenons by means of demountable surface-to-surface connections.

Such a demountable surface-to-surface connection may in particular be achieved by means of screwing.

This demountable connection thus facilitates uninstalling of the skating track. This is because, in order to carry out this uninstalling, it then suffices to proceed in the opposite way to installation.

Thus this demountable surface-to-surface connection makes it possible to independently change the skating surface or the carrier structure if one of them has excessive wear. In the same way, this skating surface can then be changed so that it has different properties (hardness, adhesion, etc.).

According to another embodiment, the skating surface is coupled to the tenons by means of permanent surface-to-surface connections.

Such a permanent surface-to-surface connection can in particular be achieved by means of adhesive bonding.

According to one solution, the skating surface consists of a single running sheet.

By virtue of this single running sheet, a skateboard ramp according to the invention, of small size, is particularly easy to produce, transport and install/uninstall.

According to another solution, the skating surface consists of an assembly of running sheets.

Such an assembly of running sheets makes it possible to obtain an advantageous modularity in the arrangement of the running sheets. This is because the user can thus obtain various forms of running track and/or various running effects according to the properties of the sheets that make up the skating track. Thus transporting a plurality of small running sheets is easier compared with a single large sheet.

According to a variant embodiment of the invention, the self-supporting carrier structure consists of a single block of rigid foam.

According to another variant embodiment of the invention, the self-supporting carrier structure consists of an assembly of self-supporting blocks of rigid foam.

Advantageously, the self-supporting blocks comprise means of mechanical connection between blocks of the tenon/mortise type in a dovetail.

Preferentially, the means of mechanical connection between blocks of the tenon/mortise type in a dovetail take the form of connecting mortises situated on the blocks and independent connecting tenons.

By virtue of this feature, the self-supporting blocks can be assembled as easily and in accordance with the same operating method as the coupling of the skating surface to the carrier structure.

According to an advantageous feature:

- the mortises intended to receive the embedded tenons allowing coupling of the skating surface and the mortises allowing mechanical connection between blocks have the same dimensions, and
- the connecting tenons consist of two independent tenons coupled together each having the same dimensions as the tenons to which the skating surface is fixed.

According to a preferential feature, each mortise emerges on at least one face of a block by means of an opening, the mortise being able to receive a tenon by means of this opening.

Advantageously, each mortise emerges on two lateral faces of a block.

Such mortises may be produced easily with straight cuts. The block or blocks may thus be produced industrially in an economical and rapid manner.

According to a preferred embodiment:

- the rigid foam is expanded polystyrene;
- the rolling sheet or sheets are made from plywood and integrate leading edges made from galvanised sheet metal;
- the tenons are made from structural timber.

A leading edge corresponds to a projecting edge or to a part of the profile of the running sheets that first come into contact with, for example, a skateboard.

BRIEF DESCRIPTION OF THE DRAWINGS

Other features and advantages of the invention will emerge more clearly from a reading of the following description of preferential embodiments of the invention given by way of illustrative and non-limitative examples, and accompanying drawings, among which.

DETAILED DESCRIPTION OF ILLUSTRATIVE EMBODIMENTS

Figure 1:
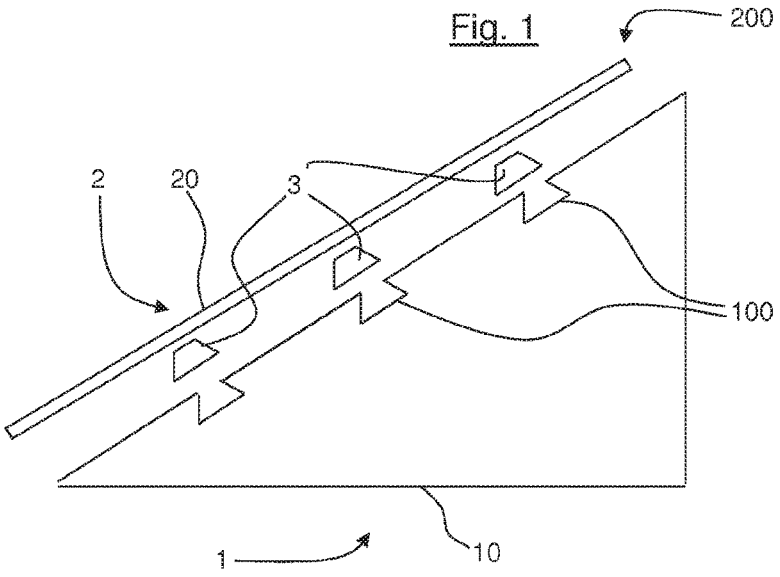
FIG. 1 is a schematic representation of a first embodiment of the invention in a side view.
Figure 2:
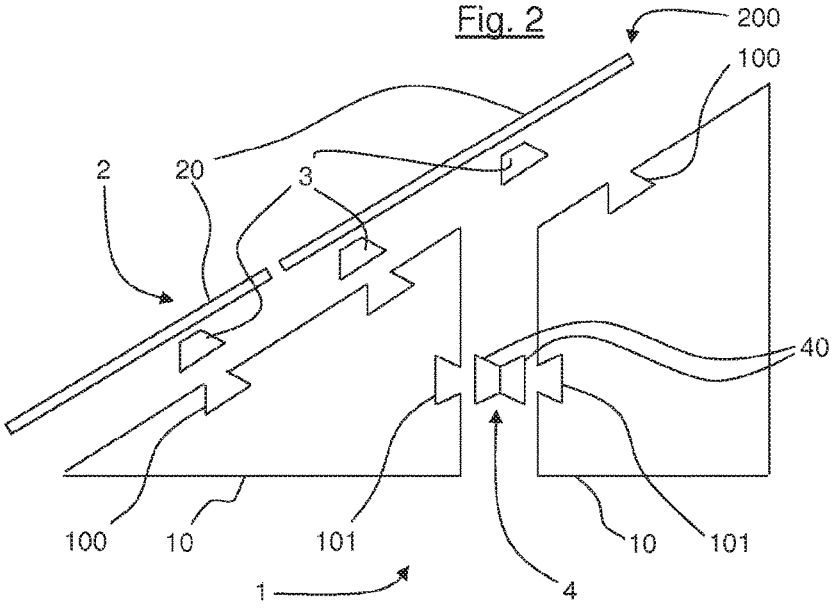
FIG. 2 is a schematic representation of another embodiment of the invention in a side view.

As can be observed in FIGS. 1 and 2, a skating track according to the invention comprises a carrier structure 1 and a skating surface 2. More precisely, the skating track is a skateboard ramp.

The carrier structure is self-supporting and formed from rigid foam.

As can be observed in FIG. 1, the self-supporting carrier structure 1 is formed from a single block 10 of rigid foam. This single block is thus self-supporting.

According to another embodiment illustrated by FIG. 2, the carrier structure 1 consists of an assembly of self-supporting blocks 10 of rigid foam.

According to these two embodiments, the blocks are thus formed only from rigid foam. More precisely, this rigid foam is expanded polystyrene.

The carrier structure 1 thus rests on the ground and the skating surface 2 can be attached thereupon.

The skating surface 2 may consist of a single running sheet 20 (FIG. 1) or consist of an assembly of running sheets 20 (FIG. 2).

These running sheets may be produced so as to have various properties (hardness, texture, adhesion, etc.) in order to modify the activities that can be carried out thereupon by a user. As may be understood, various types of running sheet may thus be used so as to adapt the skating track to a desired practice.

For example, a running sheet 20 has a top ridge 200 or the top ridge 200 of a running sheet 20 may be produced from metal so as to facilitate sliding on these ridges and to reinforce these ridges against premature wear.

These running sheets may for example be formed from plywood and integrate leading edges made from galvanised metal sheet.

According to the principle of the invention and as can be observed in FIGS. 1 and 2, the skating track comprises means for coupling the skating surface 2 and holding it in position on the carrier structure 1, which take the form of:

- mortises 100 situated on the carrier structure, more precisely on at least one face of the carrier structure intended to support a running sheet 20;
- tenons 3 embedded in the mortises 100 and to which the skating surface is fixed.

According to the present variant embodiments, the tenons 3 and the mortises 100 form a mechanical connection of the dovetail type.

The mortises 100 emerge on at least one face of a block 10 by means of openings. Thus the tenons 3 can be embedded easily in these mortises by means of these openings.

When the tenons are embedded in the mortises, the skating surface 2 can be coupled to the tenons 3 either by means of demountable surface-to-surface connections (screws, nails, etc.) or by means of permanent surface-to-surface connections (glue, etc.).

The tenons may in particular be produced from structural timber.

According to the embodiment illustrated by FIG. 2, when the self-supporting carrier structure consists of an assembly of self-supporting blocks 10, these self-supporting blocks may comprise means for mechanical connection between blocks. These means of mechanical connection between blocks may in particular be of the tenon/mortise type in a dovetail.

More precisely, the blocks 10 have connecting mortises 101 complementary to connecting tenons 4. These connecting tenons must thus be embedded in the connecting mortises of at least two blocks disposed side by side.

More precisely, the connecting tenons 4 consist of two independent tenons 40 coupled together.

Advantageously, the mortises 100 and the connecting mortises 101 have the same dimensions, and the tenons 3 and the independent tenons 40 are identical. Thus manufacture of the skating track in an industrial process is simplified and economical, the shapes to be cut in the rigid-foam blocks being repeated and the tenons being able to be produced on a production line.

Thus the blocks of rigid foam have only mortises as a means of coupling a skating surface and holding it in position or as means of mechanical connection between blocks. Thus formed, the blocks of foam do not have projecting coupling or connecting elements that would be more fragile and would risk breaking.

An exemplary embodiment of the invention overcomes these drawbacks of the prior art.

An exemplary embodiment of the invention proposes a skating track, of the skateboard ramp type, that is more simple and economical to produce than what is allowed by the prior art.

An exemplary embodiment of proposes such a skating track that is easy to transport.

An exemplary embodiment of proposes such a skating track that is easy to install and uninstall.

Although the present disclosure has been described with reference to one or more examples, workers skilled in the art will recognize that changes may be made in form and detail without departing from the scope of the disclosure and/or the appended claims.

The invention claimed is:

1. A skating track of the skateboard ramp type comprising:

a self-supporting carrier structure comprising rigid foam, which is able to rest on the ground, and mortises;

at least one running sheet having a skating surface; and a plurality of tenons, each tenon coupled to the at least one running sheet through one of a demountable connection and a permanent surface-to-surface connection;

wherein the tenons are embedded in the mortises to couple the at least one running sheet to the carrier structure and hold the at least one running sheet in position relative to the carrier structure.

2. The skating track according to claim 1, wherein the tenons and the mortises form a mechanical connection of a dovetail type.

3. The skating track according to claim 1, wherein the at least one running sheet is coupled to the tenons by demountable surface-to-surface connections.

4. The skating track according to claim 1, wherein the at least one running sheet is coupled to the tenons by the permanent surface-to-surface connections.

5. The skating track according to claim 1, wherein the at least one running sheet consists of a single running sheet.

6. The skating track according to claim 1, wherein the at least one running sheet comprises an assembly of running sheets.

7. The skating track according to claim 1, wherein the self-supporting carrier structure consists of a single block of rigid foam.

8. The skating track according to claim 1, wherein the self-supporting carrier structure comprises an assembly of self-supporting blocks of rigid foam.

9. The skating track according to claim 8, wherein the self-supporting blocks comprise mechanical connections between blocks of the tenon/mortise type in a dovetail.

10. The skating track according to claim 1, wherein each mortise emerges on at least one face of a block by an opening, the mortise being able to receive a tenon by through this opening.

11. The skating track according to claim 1, wherein the self-supporting carrier structure consists of rigid foam.

12. The skating track according to claim 1, wherein each of the plurality of tenons extends from the at least one running sheet in a direction that is perpendicular to the skating surface.

* * * * *